United States Patent [19]

Wittes

[11] 4,213,667

[45] Jul. 22, 1980

[54] DEAD FRONT CONNECTOR

[75] Inventor: James M. Wittes, Linden, N.J.

[73] Assignee: GTE Sylvania Wiring Devices Incorporated, Trenton, N.J.

[21] Appl. No.: 910,569

[22] Filed: May 30, 1978

[51] Int. Cl.[2] ..... H01R 13/58

[52] U.S. Cl. ..... 339/103 R; 339/206 R

[58] Field of Search ..... 339/195 R, 195 A, 195 M, 339/196 R, 196 A, 196 M, 206 P, 206 R, 88 R, 207 R, 210 R, 210 M, 103 R, 103 B, 107

[56] References Cited

U.S. PATENT DOCUMENTS

| | | | |
|---|---|---|---|
| 2,911,616 | 11/1959 | Townsend | 339/223 |
| 3,402,382 | 9/1968 | Detar | 339/103 M |
| 3,437,980 | 4/1969 | Smith | 339/103 R |
| 3,571,781 | 3/1971 | Gartland | 339/105 |
| 3,605,059 | 9/1971 | Lipinsky | 339/195 R X |
| 3,856,376 | 12/1974 | Poliak | 339/107 |
| 3,865,461 | 2/1975 | Ludwig | 339/103 R |
| 4,021,092 | 5/1977 | Ericson | 339/103 R |
| 4,053,198 | 10/1977 | Doyle | 339/103 R |

*Primary Examiner*—Neil Abrams
*Assistant Examiner*—John S. Brown
*Attorney, Agent, or Firm*—Frederick A. Zoda; John J. Kane; Albert Sperry

[57] ABSTRACT

An electrical connector having a tubular support through which a power cable extends, and a contact housing within which the cable is connected to male or female contacts. The support and housing have mating quick threads facilitating their assembly after connection of the cable to the contacts. A lock means on the support automatically responds to connection of the support and housing to each other, to prevent their accidental separation. Normal operation of a cable clamping device on the support clamps and strain-relieves the cable within the support. Deformation of the cable to offer strain relief acts upon the lock means to prevent its movement from the position in which it locks the housing and support against accidental separation.

A cable-clamping and strain-relieving device is disclosed, including a screw threadable laterally through an opening of a wiring device body into a power cable-receiving passage formed in the body. A swiveled head on the screw bears against the insulation of the conductor. Through the provision of guide slots in the body in which the screw is mounted, the head is maintained against rotation during advancement of the screw and removal of the screw from the body is prevented.

38 Claims, 15 Drawing Figures

DEAD FRONT CONNECTOR

BACKGROUND OF THE INVENTION

1. Field of the Invention

The dead front electrical connector comprising the present invention falls into that category of electrical wiring devices known generally to the trade as cord connectors. Connectors of this type may be male or female, and are generally attached to the ends of insulated conductors or cables for use in supplying power to portable machinery, motors, or other electrical equipment or appliances, at locations which may be remote from a permanent electrical outlet.

Connectors of this type are often attached to the associated conductors in situ, and in the circumstances it is important that the connector be adapted for quick and sure attachment to its associated conductor, and in a manner to assure to the maximum extent against loosening of the desired electrical connection of the conductor to the connector during regular use of the device. This is of particular importance considering the fact that the device may be subjected to hard and frequent use in shops, factories, and other commercial establishments, as well as in residential environments.

The connector may be generally classified as being of the type in which the conductor is inserted in one end of a body portion, which thereafter is coupled to a forward portion having male or female contacts, and provided, in the present instance, with a "dead front" for safety purposes.

The strain-relief means of the present invention may have general application to any type of electrical connector in which a conductor is to be engaged within and strain-relieved in the body of a wiring device, whether it be a male or a female cord connector, a cube tap, a cord-mounted switch, or an electrical plug or cap, to state some examples adapted for incorporation of the strain-relief therein. Other examples are electrical connections in a panel or wiring box or appliance housing.

2. Description of the Prior Art

Heretofore, cord connectors of the type referred to have generally possessed one or more of a number of undesirable characteristics.

In some instances, the cord connectors of the prior art have been exceedingly expensive, having a large number of parts which not only are high in cost, considering the cost of the parts themselves, but also, involve excessive expenditure as regards assembly labor.

In other instances, the cord connectors of the present invention have had the undesirable characteristic wherein they can be assembled on the job, or by the ultimate purchaser, only at the cost of an excessive amount of time. In such instances, it has been common to provide a plurality of elongated screws, which must be individually threaded into cooperating openings on one of the connector parts, for the purpose of assembling the cooperating connector part or parts therewith.

In still other instances, the device, when assembled with a conductor, has failed to provide sufficient guarantee that the conductor will be securely locked in place. In some instances, the conductor or power cable has no capability of holding the parts of the connector against accidental disengagement. Rather, the conductor is engaged in one of the connector parts by a means individual to that part. The connection of the connector parts, in the prior art, has then been achieved by means completely separate and distinct from the means employed to engage the cable or conductor. In still other devices, after connection of the connector parts to each other, there is nothing that responds to the act of connecting the parts and the clamping of the cable to automatically lock them together against accidental separation. Locks against accidental separation, if they do exist, in such instances must be a means separate and distinct from, and having no direct cooperation with, the means for coupling the connector body components and the clamping of the cable.

In the prior art, strain relief means has been provided, usable in cord connectors of the type previously described herein as well as in other wiring devices, that have not been possessed of the desired high efficiency as regards gripping of the conductor or cable tightly within the wiring device body. In some instances, a strain relief means is built directly into cooperating, facing portions of the body, and a means of this type is obviously highly efficient, so long as the conductor is of a prescribed exterior diameter and has insulation of a predetermined deformability. In such instances, further, strain-relief is achieved only when the body is connected, and it is necessary to completely disconnect the sections of the body, one from the other, in order to free the conductor. Such prior art devices, though efficient under the predetermined, controlled conditions described, do not allow effective discharge of the strain-relief function of the conductor size is not accurately maintained. Nor do the prior art devices allow adjustment of the strain relief according to the relative deformability of the insulation, that is, the strain relief force exerted against the conductor cannot be increased or reduced, according to the needs of the particular situation as determined by the cable size and the type and relative resistance of the insulation to deformation.

SUMMARY OF THE INVENTION

The electrical connector constituting the present invention obviates the several difficulties noted above, and may be briefly summarized as including, basically, a support for a contact housing, that receives a conductor or power cable in an axial conductor passage of the support; a contact housing that is separably assembled with the support, and which includes male or female contacts connectable to the cable; and a lock means that responds to engaging of the cable in the support in a manner effective to releasably engage the support and the housing against relative separation.

The housing and its associated support include cooperating quick threads. With the housing and support initially separated, and the conductor extended through the support, connection of stripped ends of the conductor to the several contacts can be conveniently made. Thereafter, relative rotation of the support and the contact housing through a maximum angular travel of approximately 180° couples the support and contact housing. Visual radial orientation of the parts can be dispensed with, and the act of coupling can be wholly tactile. At the conclusion of the relative rotatable movement, they automatically interlock through the connection of a spring-loaded, plunger-type lock means. Thereafter, application of a cable-clamping strain-relief incorporated in the support effects clamping, strain-relieved engagement of the conductor in the support. The clamping of the conductor causes the conductor to engage the lock means against movement in a direction that would permit separation of the support and contact housing. The assembled contact housing and support are thus caused to be lockingly interengaged against relative separation in response to clamping and strain-relieving of the cable or conductor in the support.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
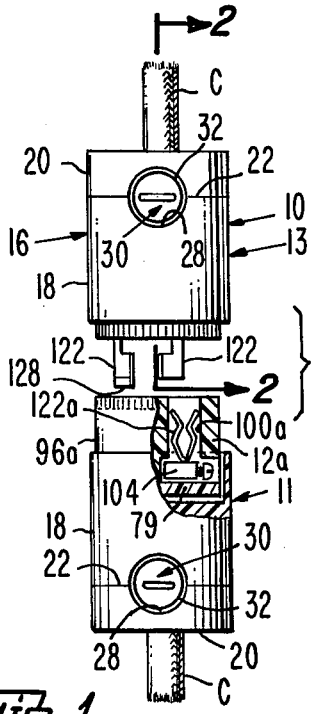
FIG. 1 is a view showing male and female cord connectors constructed according to the present invention, said connectors being illustrated in side elevation and being shown approaching a connected relationship.

Referring to FIG. 1, there are here illustrated a male cord connector 10 and a female connector 11 as they appear immediately prior to assembly. Hereinafter, the description of the preferred embodiment will proceed with reference to the male connector only. The female connector differs from the male connector only with respect to the type of contacts employed, and modification of the components of the contact housing and support to accommodate the female contacts. Modification of a contact carrier to receive a particular type of contact, whether it be a male or a female contact, is well known in the art, and accordingly special illustration of the female connector details is not believed necessary herein. The invention, it is important to note, will, however, be understood as being applicable both to connectors of the male type as well as those of the female variety.

The connector 10 may be considered as basically comprising (see FIGS. 2 and 6) a contact housing generally designated 12; a support for the contact housing generally designated 13; a lock means generally designated 14 mounted in the support and adapted for holding the support 13 and housing 12 against relative separation; and a strain-relief generally designated 30 which for purposes of the present disclosure is incorporated in the support 13 but which is believed to have general utility as a strain-relief for wiring devices of various types.

Each of these main assemblies or components will be separately described herein.

Contact Housing Support

The support 13 for the contact housing comprises an elongated, cylindrical, hollow, two-piece body 16, that includes an elongated, sleeve-like front body portion or skirt 18, the rear end of which abuts against and is ultrasonically welded or otherwise permanently, fixedly secured to a relatively short rear end portion 20. The permanent connection of the skirt 18 and the rear end portion 20, at the interface 22 thereof, is effected after assembly of the lock means 14 therewith (see FIG. 6). Since the strain-relief means is, like the lock means, interposed between the skirt and the rear end portion, it also, if desired, may be dropped into place before the skirt and rear end portion are assembled. The skirt and the rear end portion may in this event be formed with cooperating means in the form of a shoulder or shoulders, not shown, to hold the strain-relief permanently captive within the body 16.

In the female connector 11, the rear end portion 20, strain-relief 30, skirt 18, and lock means 14 would be the same as in the male connector, the only difference being a contact housing 12*a* elongated to accommodate female contacts, not shown, which in this event would be recessed wholly within the contact housing.

Figure 3:
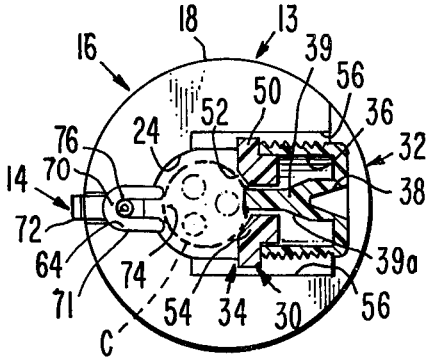
FIG. 3 is a transverse sectional view, the scale being greater than that of FIG. 1 but substantially reduced in respect to FIG. 2, taken on line 3—3 of FIG. 2 and illustrating in section the strain-relief means, the conductor being shown in chain-dotted outline.

An axial passage 24 (FIGS. 2, 3, and 6) is formed in end portion 20, receiving an insulated power cable or conductor C. Formed in the passage 24, inwardly from the end thereof, is a strain-relief rib 26, molded integrally in the wall of the passage, and extending, in a preferred embodiment, through approximately 180°. At its ends, strain-relief rib 26 merges smoothly into the surface of the passage wall. A similar strain-relief rib 26*a* is formed in the inner wall of sleeve or skirt 18 (see FIGS. 2 and 6).

Figures 6, 7, 9:
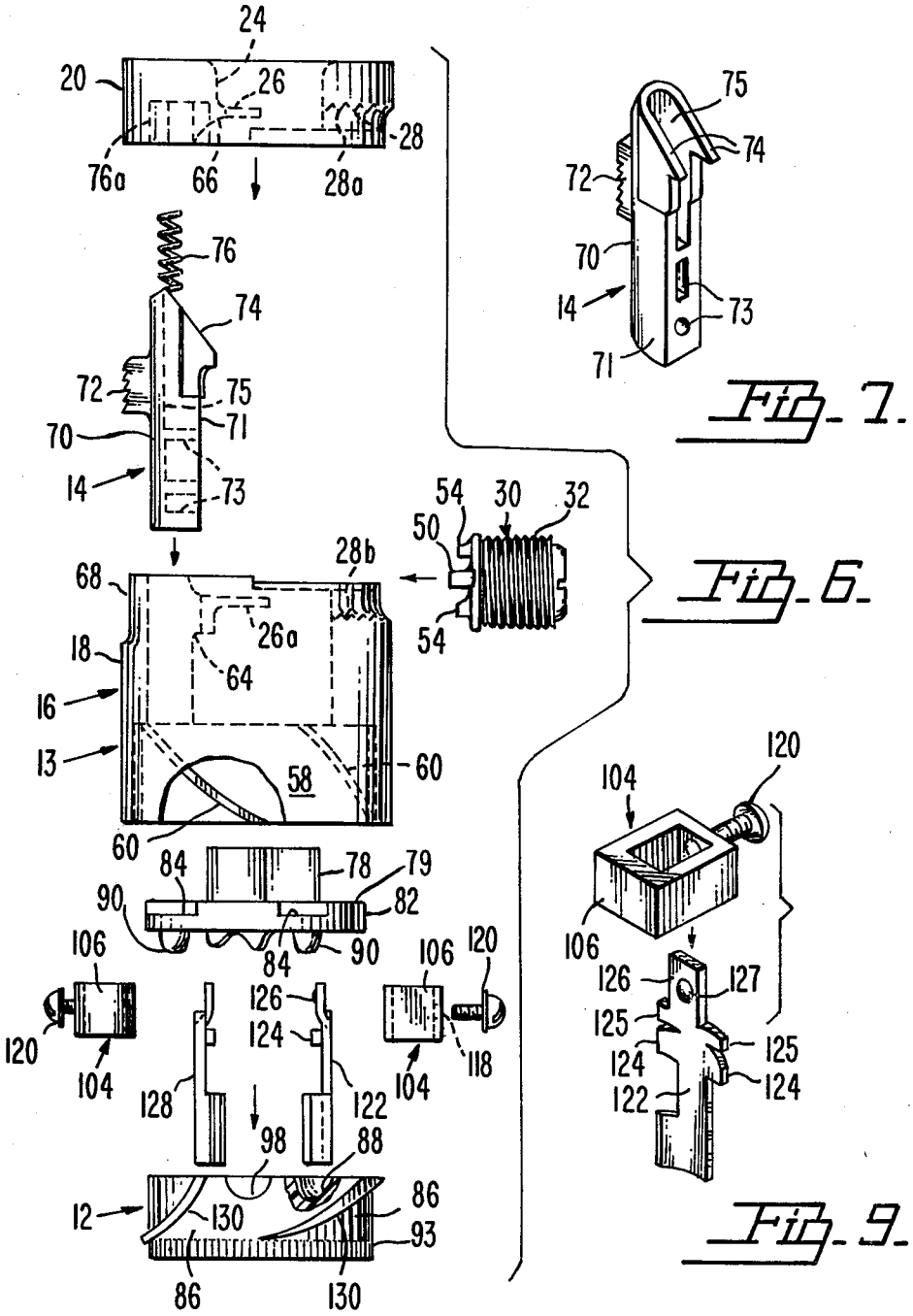
FIG. 6 is an exploded view illustrating the components of the male cord connector in side elevation, portions being broken away.
FIG. 7 is a perspective view, on an enlarged scale, of the plunger element or lock pin, per se.
FIG. 9 is an exploded perspective view of one of the contact assemblies of the male cord connector.

Diametrically opposite the strain-relief ribs 26, 26*a*, there is formed in the two piece body 16 a laterally inwardly extending, threaded opening 28 in which the strain-relief means 30 is mounted. Referring to FIG. 6, it may be noted that the opening 28 is defined by confronting, semi-circular recesses 28*a*, 28*b* of rear end portion 20 and skirt 18 respectively. The confronting recesses are formed with mating threads, so that in the assembled relationship of the skirt 18 and the rear end portion 20, said recesses cooperate to define the threaded opening 28 in which is engaged the strain-relief 30.

Strain-relief 30 comprises a screw 32 which, as is true also of the skirt 18 and rear end portion 20, may be of molded plastic material. Screw 32 (see FIG. 5) is assembled with a swiveled clamping head generally designated 34. Head 34 is swivelly mounted upon the leading or inner end of the screw, and extends into the passage in confronting relation to the permanently molded strain-relief ribs 26, 26*a*.

Since both screw 32 and head 34 may be molded of plastic material, they may also be transparent. This transparency of the two elements in combination with their large diameters, facilitates inspection of the clamped portion of the cord after it has been installed in the device. Thus, initial misplacement of the cord or possible slippage of the cord when the device is in use can readily be detected.

Figure 5:
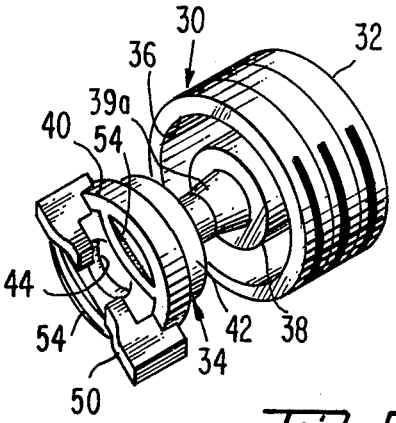
FIG. 5 is an enlarged, exploded perspective view of the strain-relief means.

Referring to FIG. 5, it will be seen that the screw 32 is formed with a deep recess 36 extending inwardly from the inner end thereof. Centrally disposed in the recess 36 is a molded boss 38 (FIGS. 2 and 5), which projects toward the open inner end of recess 36, and which is molded with an elongated axial projection 39 having a tapered inner end portion 39*a* centered upon and molded integrally with the boss 38.

Head 34 is also of molded plastic, and is formed with a circular, flat, disc-like base 40 integral with a reduced, circular, rearwardly extending portion 42 rotatably, snugly engaged in the inner end of the recess 36 of screw 32. A center opening 44 of head 34 receives the distal end of projection 39 which, after extension through the center opening, is staked or otherwise expanded as shown at 46 in FIG. 2 to hold the head and screw assembled. This may be achieved by ultrasonic, mechanical, or thermal staking, all of these methods being known in the art. In staking the end of the projection, a knurled or roughened surface may be imparted to the staked-over portion, to increase the frictional binding of the projection against the insulation of the conductor or cable C, when the conductor is clamped. This enhanced frictional engagement of the projection with the cable inhibits rotational movement of the screw in a reverse direction after it has been advanced to a position in which the swiveled clamping head is fully engaged against the cable insulation in a strain-relieving relationship to the cable.

On the front surface of the head 34, there is integrally formed a center strain-relief rib 50 extending diametrically across and molded integrally with the base, midway between a pair of like, side strain-relief ribs 54 laterally spaced from and parallel with the rib 50. In the preferred embodiment, the rib 50 projects forwardly a greater distance than do the side ribs 54. Rib 50 has, at the center of the head, an open area 52 communicating with the projection-receiving opening 44, the projection extending through the opening and being staked over the portion of the head surrounding the projection-receiving opening.

The rib 50 is formed in halves respectively disposed at opposite sides of projection 39 and extending forwardly beyond the staked end 46 thereof. Frictional engagement of the conductor insulation, by end 46, is thus promoted while destructive penetration of the cable jacket by the end 46 is prevented by the adjacent rib halves.

Rib 50 projects, at its ends, beyond the periphery of the base 40, and the projecting ends of the rib engage in diametrically opposed, elongated, parallel guide slots 56 formed in the wall of threaded opening 28. The rib ends are freely slidable within the guide slots, which engage the head against rotation, during advancement or retraction of the screw.

Figure 2:
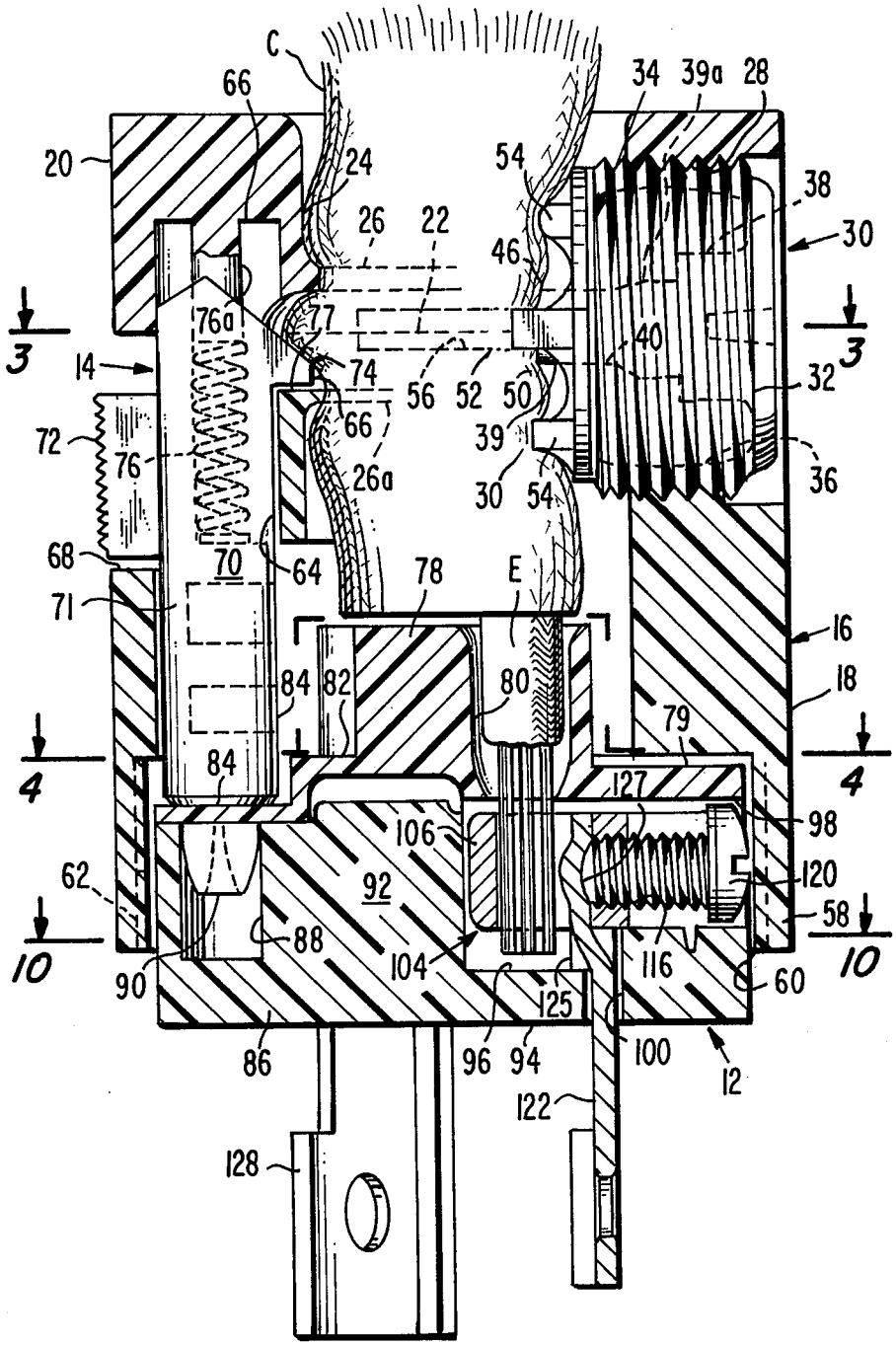
FIG. 2 is a greatly enlarged, longitudinal sectional view through the male connector, taken on line 2—2 of FIG. 1.

By reason of this arrangement, when the screw is threaded inwardly, ultimately the head will be forced against the insulation of cable C, and will be pressed into said insulation, effectively deforming or crimping the insulation about the ribs in the manner shown to particular advantage in FIG. 2. The cable is forced by the head against the opposite side of the cable passage 24, where it is further deformed and hence strain-relieved by the integral ribs 26, 26*a*. Ribs 26, 26*a* are offset longitudinally of the passage 24 from the center rib 50 and the ribs 54. The ribs 26, 26*a* occur between the center rib 50 and the respective ribs 54 as shown to best advantage in FIG. 2.

Further strain-relieving of the connection of the cable to its associated terminals, and clamping of the cable, is achieved by the lock means 14, in a manner to be discussed in further detail herein.

When the strain-relief screw 32 is advanced, as for example to the FIG. 2 position, the head 34, as it is forced into the insulation of the cable, exerts a reverse or rearwardly directed pressure against the screw. This pressure is exerted by the periphery of the base 40, against the adjacent, open end of the screw. The screw, as a consequence, is caused to bind at the location of its threads, against the female threads of the opening 28. This locks the screw frictionally against reverse rotation from a full, cable-clamping position.

At the same time, the cable engages the roughened end 46 of the projection 39, and this engagement further serves to inhibit rotational movement of the screw from its advanced, operative position. As previously noted herein, pressure of the end 46 of projection 39 against the cable jacket is limited by the rib 50 to inhibit rotation of the screw while avoiding penetration of the jacket.

Referring to FIG. 2, in the forward end of skirt 18, there is formed a bottom recess or counter bore 60, in communication with the axial passage 24, and integrally molded in the wall of the recess 60 are female threads or slots 62. The particular form of these slots is shown to best advantage in FIG. 6, from which it is seen that the slots are steeply pitched and are widely spaced. In a preferred embodiment, three uniformly angularly spaced slots are utilized. As a result, when the contact housing 12 is to be assembled with the skirt 18, they are simply brought together without need for aligning the male and female threads. A pilot section of the contact housing less than or equal to the minor diameter of the male thread facilitates axial alignment of the contact housing and skirt. A simple, partial rotation of the skirt and contact housing relative to one another is effective to register the male and female threads and thereafter quickly couple the contact housing and skirt in a position in which they are fully assembled as in FIG. 2, the dead front of the contact housing having a knurled portion protruding from the leading or forward edge of the skirt 18 to facilitate grasping thereof during assembly or disassembly.

Also formed in the skirt 18 of the body 16 (see FIGS. 2 and 6), in parallel relation to the centrally disposed conductor passage or bore 24, is a plunger or lock pin bore 64, aligned axially with a recess 66 (FIG. 2) formed in the inner face of the end portion 20. Communicating with the plunger bore 64, and opening through the side wall of the skirt 18, is a plunger handle guide slot 68.

Locking Assembly

A locking assembly or lock means generally designated 14 includes (FIG. 2) a molded, plastic, elongated locking plunger 70 formed to include a one-piece plunger element or lock pin 71 having flat sides so as to be non-rotatable in the complementarily shaped plunger bore 64 while being freely slidable in the bore in the direction of the plunger length. Projecting laterally outwardly from the lock pin 71, and molded integrally therewith, is an elongated handle 72 projecting laterally outwardly through and shiftable longitudinally within the handle guide slot 68. To save material and to shorten cure time in the mold, recesses or openings 73 are formed in the lock pin.

The lock pin is molded integrally with triangular clamping lugs 74 at opposite sides of a coil-spring-receiving, longitudinally extending recess 75 opening upon one end of the lock pin and adapted to receive a coil spring 76 held under compression (FIG. 2) between the lock pin and a projection 76*a* extending from the end wall of recess 66. The clamping lugs extend laterally inwardly, adjacent the spring-receiving end of the lock pin, through orifice 77 communicating between the cable or conductor passage 24, and the plunger bore 64.

Spring 76 normally biases the lock pin 71 in an axial direction, to the position shown in FIG. 2, in which position it is adapted, as will be described in full detail hereinafter, to releasably interlock the contact housing 12 and the contact housing support 13 against relative separation from their assembled, FIG. 2 position.

Contact Housing

The contact housing 12 is illustrated to best advantage in FIGS. 2, 4, 8, and 11. In its fully assembled condition it appears as in FIG. 11.

Figure 11:
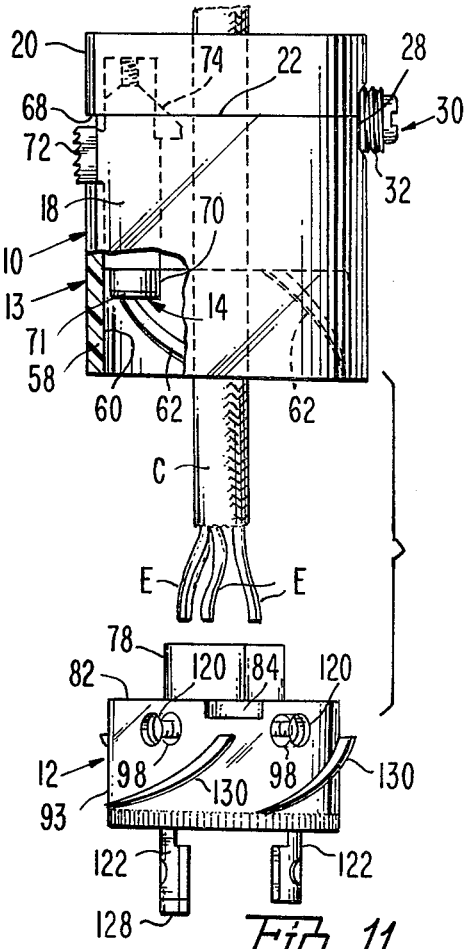
FIG. 11 is an exploded view of the contact housing and its associated support, said housing and support being shown in side elevation with portions being broken away as they appear prior to connection of the cable to the housing and assembly of the housing with its associated support.

The contact housing in the male connector 10 includes male contacts that project forwardly in the manner shown in FIGS. 1, 2, and 11. If the contact housing is of the type that receives female contacts, it would be elongated downwardly in FIG. 2, for recessing of the female contacts entirely within the body of the housing, as distinguished from the FIG. 2 arrangement in which the male contacts project beyond the insulative, plastic carrier provided therefor.

In FIG. 1, the contact housing has been generally designated 12*a* and except for elongation thereof to receive female contacts that are fully recessed, is identical in construction and use to the housing 12. Accordingly, the housing 12 description will be regarded herein as applying to the housing 12*a* except, of course, for the difference in lengths and the recessing of the contact housing 12*a* to receive female contacts, rather than projecting male contacts.

Contact housing 12 includes (see FIG. 8) a circular, flanged, preferably transparent contact carrier cover 78 of a plastic, electrically insulative material, formed as a flat, circular body 79 integral with a central, molded boss formed with side-by-side wireways 80. A three-wire connector is illustrated purely by way of example. Obviously, the number of wireways would depend upon whether the device is being made as a two-wire, three-wire, four-wire, or five-wire device, all of which are variations of the inventive concept disclosed.

Figure 8:
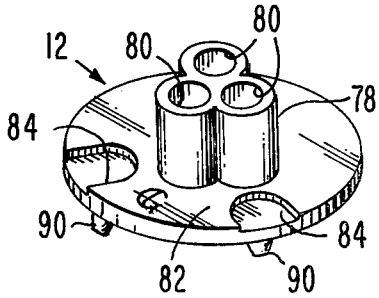
FIG. 8 is a perspective view of the cover member of the contact housing.
Figure 12:
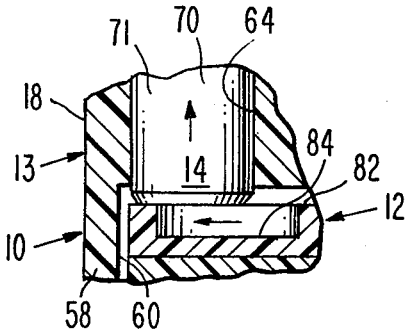
FIG. 12 is a fragmentary, detail sectional view on the same scale as FIG. 2, showing the lock pin in a retracted position to permit disassembly of the contact housing from its support.

Referring to FIG. 8, uniformly, angularly spaced about the periphery of the contact carrier cover body 79 are outwardly opening, shallow locking recesses 84, corresponding in number to the threads and thread grooves provided upon the contact housing and the interior of the skirt 18, respectively. The locking recesses are so disposed angularly upon the circumference of the carrier cover body that upon turning of the contact housing into the skirt, one of the recesses will move into axial alignment with the plunger element 71, when the contact housing reaches its innermost, final position in respect to the support body 16. This position is shown in FIG. 2. As the contact carrier cover nears the inner end wall of bottom recess 60 of skirt 18, it will slidably engage the projecting end of the spring biased lock pin or plunger element 71. Further rotatable advancement of the contact housing into the recess 60 will initially force the lock pin 71 inwardly, as shown in FIG. 12. When, however, a locking recess 84 moves into full alignment with the plunger element 71 (this will occur when the contact housing has been rotatably, inwardly advanced to its full extent), the spring 76 will now be free to expand, and will bias the plunger element into the recess 84 aligned therewith. This interlocks the contact housing 12 with the contact housing support 13, in their assembled relation shown in FIG. 2. When so interlocked, they cannot be relatively rotated from their fully assembled relationship shown in FIG. 2.

The flat top surface of the carrier cover body 79 has been designated at 82, and recesses 84 are formed in said top surface, the bottoms of the recesses terminating short of the underside of the carrier cover. Molded integrally with the underside of the carrier cover, and extending downwardly therefrom in alignment with the respective recesses 84, are downwardly tapering projections 90. These extend into upwardly opening recesses 88 of a contact carrier 86 also of molded plastic material. Recesses 88 and projections 90 provide for accurate orientation of the contact carrier cover 79 in respect to its associated, underlying contact carrier 86, not only for the purpose of properly locating the stripped ends E of the conductor in respect to terminals carried by the carrier 86, but also, for the important purpose of properly orienting the locking recesses 84 in relation to male threads integrally molded upon the exterior of the carrier 86 for engagement in grooves 60 of skirt 18.

Figure 10:
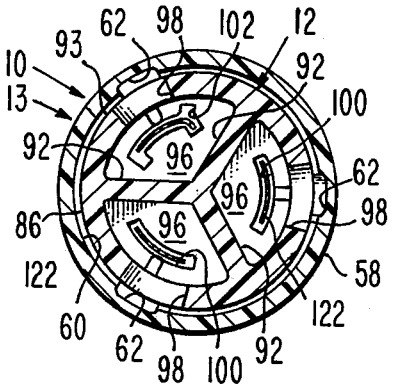
FIG. 10 is a transverse sectional view on the same scale as FIG. 3, taken on line 10—10 of FIG. 2.

In a preferred embodiment (see FIG. 10) contact carrier 86, unlike the carrier cover 79, is not transparent, but is nevertheless formed of molded plastic, electrically insulative material. As shown in FIG. 10, the carrier 86 is molded integrally with a series of radial partitions 92 integrally joined at the center of the carrier and extending outwardly to an integral connection to the side wall 93 of the contact carrier. The partitions 92 are also integral with a front wall 94 of the contact carrier, which constitutes the "dead front" of the cord connector. The term "dead front" is understood as meaning a front end construction, in an electrical connector, wherein the molded housing material extends fully across the front, with all terminal connections disposed in back of it and without access to the interior. In a "dead front" device such as that illustrated, the only electrically conductive elements accessible at the front are the male or female contacts themselves.

The partitions 92, side wall 93, and the dead front 94 cooperate to define rearwardly opening contact cavities 96 which in the present instance, the connectors being a three-wire device, are three in number as shown in FIG. 10, each receiving a contact and its associated terminal, in a manner to completely insulate the same electrically from contacts and terminals adjacent thereto.

Communicating with each contact cavity, as shown in FIGS. 2 and 10, are laterally opening, generally semicircular terminal-screw-receiving notches or side openings 98. Also communicating with each contact cavity through the dead front, are contact-receiving slots. In the present instance, in a three-wire device of the type illustrated, there are two line contact slots 100, and one grounding contact slot 102, which differs from the line contact slots by reason of having a special lateral extension or extensions at its ends, according to contact configurations that are standard in the wiring device industry.

At this point it may be noted that the particular cord connector illustrated is of the locking type in which the male and female cord connectors are relatively rotated to join the same, and move into a relationship in which they are interlocked against accidental separation. The invention could, of course, be applied equally well to connectors of the straight blade type.

In the illustrated example, each contact is engaged in the associated contact cavity, at the inner end of the contact, through the provision of a terminal collar 104, which may be as shown, a wholly conventional type capable of being purchased on the open market. As shown in FIG. 9, terminal 104 includes, in the illustrated example, a rectangular yoke 106, seating in the associated cavity, and having a threaded opening 118 in one end adapted to receive a machine screw 120 which, in the illustrated example, is of the washer head type.

It will be understood that the cover body 79 is ultrasonically welded or otherwise permanently secured, during manufacture, to the contact carrier 86. By making the cover transparent, the user can observe whether the terminals are in clamped or open position and whether the inserted wires are properly located and fully inserted in the terminals.

In the illustrated example the line contacts have been designated 122, and as shown include laterally outwardly projecting, curved lugs 124 which seat within the slots 100 to close the slots over the full length thereof in the assembled relationship of the contacts and carrier. Immediately adjacent the lugs 124 there are provided laterally outwardly extending stop shoulders 125, which are extended straight outwardly from the body of the contact, and as shown in FIG. 2 are offset inwardly from the slots 100 so as to bear against the bottom surfaces of the contact cavities.

At their inner ends, the contacts as noted above are slightly offset radially inwardly of the contact carrier (FIG. 2), and extend into the terminal yokes 106, being formed at their inner ends with inwardly offset tabs 126 for this purpose. Tabs 126 have partly-spherical projections 127 to improve the quality of the electrical connection between the terminals and the cable ends.

The stripped ends of the conductor, as shown in FIG. 2, are extended into the yokes, and responsive to advancement of the screws, are effectively clamped between tabs 126 and the yoke walls remote from the screws.

The ground contact in the illustrated example has been designated 128 and of course has a standard configuration at its distal end, for ground contacts of the type and electrical rating illustrated by way of example. At its inner end, the ground contact is formed similarly to the line contacts. The contact carrier cover, as shown in FIG. 8, may have a marking "G" adjacent one of the wireways to assure connection of the ground wire of conductor C to the ground contact 128.

Referring to FIG. 1, in the female connector 11, terminals 104 are identical to those already described. In this form of the invention, however, the female contacts have been designated **122*a*, and at their distal ends are of well-known, standard configuration adapted to receive the line contacts 122 or the grounding contact 128 as the case may be. At their inner ends, the contacts 122*a* would be formed similarly to the contacts 122, 128, that is, they would have the stop shoulders 125 and the tabs 126 extending into their associated yokes 104. In this form of the invention, as previously noted, the contact slots 100*a* are elongated in the axial direction, to accommodate the full length of the female contacts and assure their being wholly recessed within the material of the contact carrier 96*a***.

Molded upon the exterior surface of the carrier side wall 93 (see FIGS. 6 and 11) is a series of uniformly, angularly spaced quick threads 130 corresponding in number to the thread grooves 60. In the form of the contact carrier used for the female connector 11, the quick threads would be identical to those shown in FIG. 6 for the male connector, and it will be also understood that the female thread grooves 60 of skirt 18 would similarly be identical in length and location in both the male and female connector structures.

Operation

In use of the device, it will be understood that the contact housing 12 will be factory-assembled in the form shown in FIG. 11. The same is true of the contact housing support 13 illustrated in its fully assembled form in FIG. 11.

The user of the device first strips ends E of the conductor or power cable C, after extending the power cable through the conductor passage 24 to the position shown in FIG. 11. The stripped ends E are then inserted through wireways 80, moving into the yokes 106 to the position shown in FIG. 2. Screws 120 are then turned home, to tightly clamp the stripped ends in the yokes.

Figure 4:
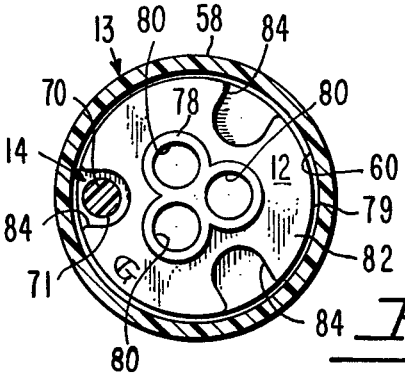
FIG. 4 is a tranverse sectional view on the same scale as FIG. 3, on line 4—4 of FIG. 2, in which the contact housing is shown in top plan.

The contact housing is then assembled with the housing support 13 in the manner previously described herein, that is, the housing support 13 is merely moved downwardly along the cable after the cable ends have been secured within the yokes, until the pilot portion of the contact housing 12 (or **12*a* in the case of the female connector) enters skirt 18. Then the skirt is rotated relative to the contact housing. This requires use only of the tactile sense, rather than a conscious requirement of visual orientation of the skirt and housing relative to each other. Relative rotation through a few degrees will cause thread grooves 62 to align with the inner ends of the male quick threads 130 of the contact housing. It is immaterial which thread grooves align with which threads. Further relative rotation of the housing support 13 relative to the contact housing, through perhaps 90°, more or less, causes the housing and the housing support to move into their fully assembled relationship shown in FIG. 2. As previously noted herein, during this assembly the lock pin 71 is initially pressed back by the flat top surface of the carrier cover 78, but is biased forwardly into one of the locking recesses 84 in the fully assembled relationship of the contact housing and its associated support. The final position of the parts is shown in FIG. 4, and also in FIG. 2**.

The strain-relief 30 is now operated, screw 32 being advanced until the cable is tightly engaged by and between strain-relief ribs 26, 26*a* and the ribs 50, 54 of the strain-relief head 34. In these circumstances the insulation of the cable is pressed inwardly and is deformed in the manner shown in FIG. 2, at diametrically opposite locations on the cable, by the ribs 26, 26*a*, 50, 54.

When the cable is forced to its clamped, strain-relieved position shown in FIG. 2, as previously noted the cable itself acts as a means (though not the only means) for locking the strain-relief screw against retrograde movement. Very importantly, however, and as clearly shown in FIG. 2, at a location diametrically opposite the swiveled clamping head the cable insulation is forced into the clamping orifice 77, against the clamping lugs 74. The cable insulation bulges into the space between the angled surface of the lugs 74 and the wall of orifice 77 spaced from the lugs.

The angled surface of lugs 74 serves a three-fold purpose. First, if plunger 70 does not seat fully in bore 64, the cable jacket when forced against the lugs will exert a cam action against the angled surface and will bias the plunger to a fully seated position. Second, on disassembly the cable insulation tends to remain deformed with its bulge remaining in the space above the lugs. The angled surface will cammingly bias the jacket material out of the path of the lugs as the plunger is lifted, to free the contact housing for release. Third, because the angled surface is angled away from the cable and is recessed in respect to rib 26*a* (see FIG. 2) any excessive, extremely heavy pull on the cable tending to cause it to slide upwardly in FIG. 2, will not engage and lift the plunger to a release position.

Bulging of the cable into the space above the angled surface prevents the movement of the lock pin from its locking position shown in FIG. 2. Even if one engages the handle 72 and attempts to shift the lock pin away from its locking position shown in FIG. 2, there can be no movement of the lock pin because of the engagement thereof by the inwardly bulged cable insulation. The cable thus acts as a stop, when the cable is clamped, limiting movement of the lock pin from its locking position shown in FIG. 2.

At such time as it may be desired to disassemble the device from its fully assembled, cable-clamping, use position shown in FIG. 2, one merely backs off the screw 32. The cable is now loose in the passage 24, and moves out of the path of movement of the lugs 74. By "path of movement" is meant the paths that the lugs would travel when the lock pin is shifted from the FIG. 2 position to its retracted position shown in FIG. 13.

Figure 13:
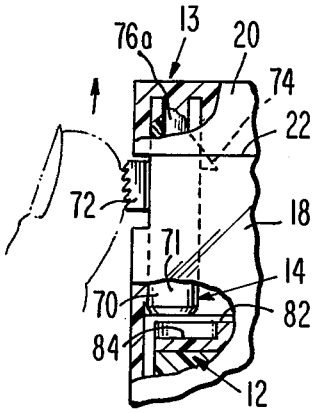
FIG. 13 is a fragmentary view, partly in side elevation and partly in longitudinal section, showing the lock pin as it appears while being shifted to its retracted, unlocking position.

With the cable loose in the passage, one can now, as shown in FIG. 13, operate the plunger to its retracted position against the restraint of spring 76. This disengages the lock pin from its associated locking recess 84. As a result, with the cable loose in passage 24 and the lock pin temporarily held in retracted position, one merely relatively rotates contact housing support 13 in respect to contact housing 12, in a direction to thread the contact housing out of the body 16 of the housing support.

In this way, an extremely effective, safe device is provided, which will assure that the cable will be securely clamped and strain-relieved in the use condition of the device. Further, the device is especially well adapted for quick assembly and disassembly in situ. The cable itself, responsive to its being clamped and strain-relieved, becomes a means for engaging the locking assembly 14 against movement from its locking position shown in FIG. 2, and at the same time, the cable further serves as means cooperating with the swiveled head 34 in engaging the set screw against accidentally backing out from its inwardly advanced, strain-relieving position shown in FIG. 2.

The female connector is, of course, identical to the male connector in every respect except for the length of the contact housing, and its modification to receive female rather than male contacts. Beginning at a location designated by the cutting plane 10—10 of FIG. 2, and for the remainder of the length of the device when one looks toward the cable entrance end thereof, the female and male connectors are identical in every respect.

Figure 15:
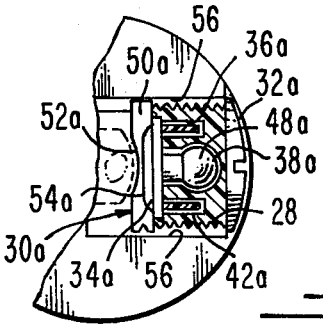
FIG. 15 is a fragmentary transverse sectional view similar to FIG. 3, illustrating the strain-relief means of FIG. 14 mounted in the cord connector.
Figure 14:
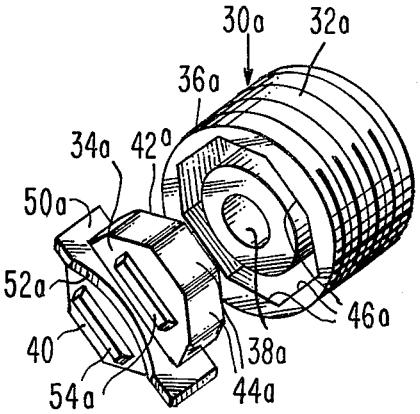
FIG. 14 is a view like FIG. 5 showing a modified strain-relief means.

A modified construction of the strain-relief is illustrated in FIGS. 14 and 15. In the modified arrangement, wherein the strain-relief has been generally designated 30*a*, the set screw 32*a* is formed with a deep, annular slot 36*a* opening upon the inner end of the set screw, and with an axial recess 38*a* also opening upon the inner end of the screw as shown in FIG. 15. Recess 38*a* may be formed with a slight enlargement at its inner end, which can be readily achieved in the molding operation by maintaining the required undercut in the mold within parameters permissible in molding techniques where a part has to be stripped from the mold.

In any event, in this form of the invention the outer wall of the annular recess 36*a* is formed with a continuous series of straight facets 46*a*, complementing corresponding facets 44*a* formed on the outer surface of the body 42*a* of a swiveled clamping head 34*a* having a diametrically extending main strain-relief rib 50*a* and parallel, secondary strain-relief ribs 54*a*.

Referring to FIG. 15, integrally molded with the body of the clamping head is a rearwardly extending stem 48*a*, having an enlarged head at its distal end.

In this arrangement, the swiveled head is first assembled with the screw, by pressing the stem into the recess 38*a*. The head and screw in effect are snapped together, with the head thus being captive on the screw but being freely rotatable in regard thereto.

As the screw is advanced, the facets 44*a*, 46*a* will produce a gentle clicking during rotation of the screw relative to the clamping head which, as previously described, does not turn as it moves forwardly within the guide slots 56. This provides a tactile indexing feature, that is, as the user advances the screw, the user feels the gentle ratcheting or clicking action as the screw turns. Eventually, as the swiveled clamping head moves into its full clamping position, the feel becomes more pronounced, and ultimately, the user, by the tactile indexing feature, knows that the screw has been advanced to the desired extent to assure a good clamping and strain-relief of the cable. In this arrangement, further, in the final position of the screw, facets 44*a* would be in registration with facets 46*a*, and this aids in preventing reverse rotation of the screw. The facets have an interference with each other as the screw rotates relative to the head. Accordingly, the screw would not rotate past the several, uniformly angularly spaced interference points in and of itself, requiring instead a more positive force such as would be exerted by the torque of a screwdriver in the hands of a user.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An electrical connector of the type attachable to an end portion of a power cable, comprising:

(a) a support for a contact housing including a body having a bore for receiving the end portion of a cable, and means mounted on the body for movement across the bore into clamping engagement with said power cable end portion;

(b) a contact housing separably assembled with said body and including contacts connectable to the end portion of the cable; and (c) lock means mounted between the body and the contact housing for travel along a path between a locking position preventing relative separation of the contact housing and body and an unlocking position permitting such separation, said first named means being adapted to bias the cable portion to a location effective to dispose in said path an abutment blocking travel of the lock means from its locking position.

2. An electrical connector as in claim 1 wherein the first named means on the body comprises means for strain-relieving the cable within the bore, said strain-relieving means being operable to exert pressure against the engaged end portion of the cable in a direction to strain-relieve it and, at the same time, bias it to said location.

3. An electrical connector as in claim 1 wherein said first named means includes means for forcing the engaged portion of the cable into said path and for deforming it to a shape defining the abutment blocking the lock means against displacement from its locking position.

4. An electrical connector as in claim 1 wherein the lock means is resiliently, yieldably biased to its locking position and occupies said position in response to assembly of the support and housing so as to interengage the support and contact housing against relative separation, the lock means being manually operable to its unlocking position in which it permits the separation of the support and lock means and being restrained from manual operation whenever the cable end portion is clampably engaged in the support to dispose the abutment in the path of travel of the lock means.

5. An electrical connector as in claim 4 in which the lock means, when in its locking position, includes a surface lying transversely of said path of travel in direct abutting relationship to the abutment whereby to restrain the lock means against movement from its locking position.

6. An electrical connector of the type attachable to an end portion of a power cable, comprising:

(a) a contact housing support adapted for engaging a power cable end portion;

(b) a contact housing separably assembled with said support and including contacts connectable to the end portion of the cable; and (c) lock means responding to the engagement of the power cable end portion in the support to releasably engage the support and housing against relative separation, said support comprising (1) a body having a bore in which the end portion of the cable is engaged, the lock means being partially exposed within the bore and being movable between a locking position in which it engages the support and housing against relative separation, and an unlocking position in which it frees them for separation, and (2) means in the body entering the bore at a location angularly spaced from the exposed part of the lock means, for exerting pressure against the cable to deform the same for strain-relief purposes and force it against the exposed part of the lock means, thereby to prevent displacement of the lock means from the locking position thereof.

7. An electrical connector as in claim 1 in which the lock means comprises a plunger mounted on the support for rectilinear sliding movement along said path between the locking and unlocking positions thereof, the support part being mounted for movement in a direction effective to bias the cable end portion transversely of the line of sliding movement whereby said abutment enters into its blocking position along a path intersecting the path of movement of the plunger substantially perpendicularly thereto.

8. An electrical connector as in claim 1 in which the lock means comprises a plunger on the support mounted for sliding rectilinear movement along said path between its locking and unlocking positions and releasably engaging the housing against separation from the support when moved to its locking position, the plunger being spring-biased to its locking position into its engagement with the housing and the abutment being disposed in the path of movement of the plunger whenever the cable end portion is clampably engaged in the support, said plunger being accessible for retraction by a user to its unlocking position against the spring bias upon disengagement of the cable end portion to an extent removing the abutment from its blocking location, thus to free the housing and support for separation.

9. An electrical connector of the type attachable to an end portion of a power cable, comprising:

(a) a contact housing support adapted for engaging a power cable end portion;

(b) a contact housing separably assembled with said support and including contacts connectable to the end portion of the cable; and (c) lock means responding to the engagement of the power cable end portion in the support to releasably engage the support and housing against relative separation, said lock means comprising a plunger on the support releasably engaging the housing against separation from the support, the plunger being spring-biased into its engagement with the housing and being accessible for retraction by a user against the spring bias to free the housing and support for separation, the path in which the plunger moves when retracted being at least partially blocked by the end portion of the cable to prevent the retraction of the plunger, and the consequent freeing of the housing and support for separation, whenever the end portion of the cable is engaged in the support.

10. An electrical connector as in claim 9 wherein the plunger has a laterally extended projection against which the cable end portion bears to effect the blockage of the path in which the plunger moves when retracted.

11. An electrical connector as in claim 1 wherein the support is formed with a passage through which the cable end portion is extendable, the support including means shiftable transversely of the passage to press the cable end portion laterally against the wall of the passage and thereby engage it in the support, the lock means having a surface disposed in the path of lateral movement of the cable end portion and extending transversely of the lock means to deform the cable end portion into engagement with said surface and thereby define said abutment whenever the cable end portion is pressed against said wall.

12. An electrical connector of the type attachable to an end portion of a power cable, comprising:

(a) a contact housing support adapted for engaging a power cable end portion;

(b) a contact housing separably assembled with said support and including contacts connectable to the end portion of the cable; and (c) lock means responding to the engagement of the power cable end portion in the support to releasably engage the support and housing against relative separation, the support being formed with a passage through which the cable end portion is extendable, the support including means shiftable transversely of the passage to press the cable end portion laterally against the wall of the passage and thereby engage it in the support, the lock means being partially exposed through the wall of the passage, the end portion of the cable bearing against the exposed part of the lock means to prevent its movement from a position in which it holds the support and housing against relative separation.

13. An electrical connector as in claim 12 in which the transversely shiftable means includes at least one strain-relief rib bearing against the cable end portion at one side thereof, the lock means having a complementary strain-relieving means comprising the part thereof exposed within the passage, against which the other side of the end portion of the cable is forced and which cooperates with the rib to strain-relieve the engaged cable portion and hold the lock means against movement from a position preventing separation of the support and housing.

14. An electrical connector as in claim 13 in which the lock means includes a lock pin maintained under spring-bias in a direction longitudinally of the cable passage to engage the support and housing against separation, means on the pin for shifting it in a reverse direction against the spring bias to permit separation of the support and housing, and a lug extending laterally from the pin and comprising the exposed strain-relieving means, the lug and rib cooperating to deform the cable end portion for strain-relief thereof, with the deformed cable portion exerting a lateral pressure against the lug to prevent shifting of the pin in the reverse direction.

15. An electrical connector as in claim 1 in which the support and housing have interengaging means cooperating to assemble the support and housing responsive to relative rotation of the same about a common axis in one direction to an assembled position in which they are substantially in end-to-end abutting relation, the path of travel of the lock means being parallel to said axis with the lock means being resiliently biased along said path to a position extending between and interengaging the abutting ends against rotation in a reverse direction.

16. An electrical connector as in claim 15 in which the interengaging means are mating threads on the housing and support respectively.

17. An electrical connector as in claim 16 in which the housing has a series of angularly spaced locking recesses disposed radially outwardly from said common axis and successively moving into the path of the lock means when the housing and support are relatively rotated to their assembled condition whereby any one of said recesses is engageable by the lock means responsive to threaded advancement of the support and housing into said end-abutting relation.

18. An electrical connector of the type attachable to an end portion of a power cable, comprising:

(a) a contact housing support adapted for engaging a power cable end portion;

(b) a contact housing separably assembled with said support and including contacts connectable to the end portion of the cable; and (c) lock means responding to the engagement of the power cable end portion in the support to releasably engage the support and housing aganst relative separation, the support and housing having interengaging means cooperating to assemble the support and housing responsive to relative rotation of the same in one direction to an assembled position in which they are substantially in end-to-end abutting relation, the lock means extending between and interengaging the abutting ends against rotation in a reverse direction, the interengaging means comprising mating threads on the housing and support respectively, the housing having a series of angularly spaced locking recesses any one of which is engageable by the lock means responsive to threaded advancement of the support and housing into said end-abutting relation, said locking means comprising a pin spring-biased in a direction to engage in one of said recesses when the support and housing are assembled, a handle on the pin for shifting it in a reverse direction when the support and housing are to be disassembled, and a laterally extending lug under pressure from the cable end portion when it is engaged in the support to prevent shifting of the pin in the reverse direction.

19. An electrical connector as in claim 18 in which the support includes a strain-relief means shiftable transversely thereof against the cable end portion to force it against the lug, for engaging and strain-relieving the cable end portion in the support, and for holding the lock pin against its being shifted in a reverse direction out of the housing recess in which it is engaged.

20. An electrical connector of the type attachable to an end portion of a power cable, comprising:

(a) a contact housing support adapted for engaging a power cable end portion;

(b) a contact housing separably assembled with said support and including contacts connectable to the end portion of the cable; and (c) lock means responding to the engagement of the power cable end portion in the support to releasably engage the support and housing against relative separation, the support and housing having interengaging means cooperating to assemble the support and housing responsive to relative rotation of the same in one direction to an assembled position in which they are substantially in end-to-end abutting relation, the lock means extending between and interengaging the abutting ends against rotation in a reverse direction, the interengaging means comprising mating threads on the housing and support respectively, the housing having a series of angularly spaced locking recesses any one of which is engageable by the lock means responsive to threaded advancement of the support and housing into said end-abutting relation, said mating threads being quick threads corresponding in number to the recesses and located angularly of the housing in predetermined position in respect to the recesses, to align and engage the lock means with one of the recesses responsive to interengagement of any of the support and housing threads and relative threaded advancement of the housing and support into their end-abutting relationship.

21. In a wiring device of the type that includes a body of electrically insulative material having an axial passage for an electrical conductor, the improvement comprising:

1. a screw threadedly engaged in the body for advancement transversely of and into the passage, the body having a laterally inwardly extending opening entering upon the passage and formed with threads engaging the threads of the screw; and
2. a clamping head swivelled on the screw for advancement therewith into and transversely of the passage and having a clamping surface facing away from the screw adapted for exerting pressure on the conductor effective to clampingly engage it against the wall of the passage at a location diametrically opposite that at which said opening enters upon the passage, when the screw is advanced.

22. The wiring device improvement of claim 21 in which the body has guide slots formed in the wall of said opening and continuing into the passage, said slots paralleling the screw axis and slidably engaging portions of the head to prevent the head from rotating with the screw.

23. The wiring device improvement of claim 22 in which the head has ears extending radially, outwardly therefrom beyond the major diameter of the screw and comprising the portions of the head engaged in the slots.

24. The wiring device improvement of claim 22 in which said clamping surface of the head is formed with at least one rib projecting forwardly therefrom in a direction away from the screw and facing into the passage to deform and thereby strain-relieve the conductor when the head exerts pressure thereon.

25. The wiring device improvement of claim 24 in which the rib extends diametrically of the head and projects radially outwardly therefrom at its ends to define the ears.

26. The wiring device improvement of claim 25 in which said clamping surface of the head includes a pair of forwardly projecting secondary ribs paralleling the first named rib at opposite sides thereof and also facing into the passage in a direction away from the screw, said secondary ribs cooperating with the first named rib in deforming and strain-relieving the cable.

27. In a wiring device of the type that includes a body having a passage for an electrical conductor, the improvement comprising:

(1) a screw threadedly engaged in the body for advancement into the passage; and (2) a clamping head swivelled on the screw and adapted for exerting pressure on the conductor effective to clampingly engage it in the passage when the screw is advanced, the body having guide slots paralleling the screw axis and slidably engaging portions of the head to prevent the head from rotating with the screw, the head and screw having complementary means producing interference between the screw and head at predetermined intervals during rotation of the screw relative to the head to provide at least a tactile reference to a user in the form of step-by-step indexing of the advancing screw.

28. The wiring device improvement of claim 27 in which the complementary means comprises facets arranged in a circumferential series upon the screw and head respectively and slidably contacting one another when the screw is rotated.

29. The wiring device improvement of claim 28 in which the screw has an annular recess and the head has a mating annular flange extending into the recess, the facets being formed on confronting faces of the flange and recess respectively.

30. In a wiring device of the type that includes a body having a passage for an electrical conductor, the improvement comprising:

(1) a screw threadedly engaged in the body for advancement into the passage; and (2) a clamping head swivelled on the screw and adapted for exerting pressure on the conductor effective to clampingly engage it in the passages when the screw is advanced, the screw including a projection extending through the clamping head, the clamping head being rotatable upon said projection, said projection extending forwardly through the clamping head for frictional, binding engagement against the conductor whereby to assist in clamping the conductor within said passage, while being retained frictionally by the conductor against rotation of the screw from selected positions to which it is advanced.

31. In a wiring device of the type that includes a body having a passage for an electrical conductor, the improvement comprising:

(1) a screw threadedly engaged in the body for advancement into the passage; and (2) a clamping head swivelled on the screw and adapted for exerting pressure on the conductor effective to clampingly engage it in the passage when the screw is advanced, said clamping head being formed with a plurality of parallel, forwardly projecting strain relief ribs adapted to bear against the conductor at selected locations longitudinally spaced along the conductor, for strain relief of the conductor responsive to threaded advancement of the screw.

32. In a wiring device of the type that includes a body having a passage for an electrical conductor, the improvement comprising:

(1) a screw threadedly engaged in the body for advancement into the passage; and (2) a clamping head swivelled on the screw and adapted for exerting pressure on the conductor effective to clampingly engage it in the passage when the screw is advanced, said clamping head having a center opening, the screw including an axial projection extendable through the center opening for rotatable movement of the clamping head upon the projection, said clamping head including a plurality of forwardly projecting, generally parallel, spaced strain relief ribs, one of said ribs extending diametrically of the head and being interrupted by said opening, the axial projection extending through the opening and being staked over said diametrically extending rib, for holding the head and screw assembled, the projection being formed at the location where it is staked, with a roughened surface engageable against the conductor, whereby to frictionally interengage the conductor and the axial projection, to inhibit rotation of the screw in a reverse direction from a selected position to which the screw is advanced.

33. In an electrical connector of the type having a contact carrier support member formed with a passage for a cable, and a contact carrier member provided with contacts, and with terminal means for making an electrical connection of the cable to the contacts, the improvement comprising:

(1) complementary means on the carrier member and support member respectively operative to connect the same in axially aligned relation responsive to their relative rotation, said members having end surfaces that confront each other and are adapted to move into substantially abutting relation when the members are connected; and (2) lock means on one of said members interengaging the members against rotation in the connected relationship of the members, said lock means comprising a plunger slidably mounted in said one member in radially spaced relation to the axis of rotation of the members and spring-pressed through the end surface of said one member along a path parallel to said axis, the other member having an annular series of recesses in the end surface thereof any one of which is disposed to receive the spring-pressed plunger on relative rotation of the members to an extent effective to dispose the end surfaces in said substantially abutting relationship.

34. In an electrical connector the improvement of claim 33 wherein the complementary means comprises threads on the members.

35. In an electrical connector the improvement of claim 34 wherein the threads are quick threads.

36. In an electrical connector of the type having a contact carrier support member formed with a passage for a cable, and a contact carrier member provided with contacts, and with terminal means for making an electrical connection of the cable to the contacts, the improvement comprising:

1. complementary means on the carrier member and support member respectively operative to connect the same in axially aligned relation responsive to their relative rotation; and
2. lock means on one of said members interengaging the members against rotation in the connected relationship of the members, the complementary means comprising threads on the members, the threads being quick threads, said lock means comprising a plunger mounted on said one member and radially spaced from the axis of relative rotation of the members under a spring bias tending to urge the plunger toward the other member, the other member having at least one recess into which the plunger is biased when the members are threadedly connected to prevent relative rotation of the members from their connected relationship.

37. In an electrical connector the improvement of claim 34 wherein said other member has a series of recesses anyone of which is adapted to receive the plunger, said recesses being angularly spaced about the axis of rotation of the members, relative to the angular spacing of the threads, such that one of the recesses will move into axial alignment with and will engage said plunger when the members are threaded together to their full extent.

38. In an electrical connector the improvement of claim 36 wherein the plunger includes a handle accessible to a user for retracting the plunger against the spring bias thereof to free the members for disconnection from each other.

* * * * *

UNITED STATES PATENT AND TRADEMARK OFFICE

CERTIFICATE OF CORRECTION

PATENT NO. : 4,213,667

DATED : July 22, 1980

INVENTOR(S) : James Matthew Wittes

It is certified that error appears in the above-identified patent and that said Letters Patent are hereby corrected as shown below:

Column 2, line 28, change "of" to --if--

Column 2, line 61, change "connection" to --operation--

Claim 37, line 2, change "34" to --36--

Signed and Sealed this

*Twentieth* Day of *January 1981*

[SEAL]

*Attest:*

RENE D. TEGTMEYER

*Attesting Officer*

*Acting Commissioner of Patents and Trademarks*